US009032736B2

(12) United States Patent
Hase

(10) Patent No.: US 9,032,736 B2
(45) Date of Patent: May 19, 2015

(54) METHOD FOR OPERATING A BURNER AND BURNER, IN PARTICULAR FOR A GAS TURBINE

(75) Inventor: Matthias Hase, Mülheim (DE)

(73) Assignee: Siemens Aktiengesellschaft, München (DE)

( * ) Notice: Subject to any disclaimer, the term of this patent is extended or adjusted under 35 U.S.C. 154(b) by 911 days.

(21) Appl. No.: 13/256,293

(22) PCT Filed: Mar. 16, 2010

(86) PCT No.: PCT/EP2010/053325

§ 371 (c)(1),
(2), (4) Date: Sep. 13, 2011

(87) PCT Pub. No.: WO2010/106034

PCT Pub. Date: Sep. 23, 2010

(65) Prior Publication Data

US 2012/0000203 A1 Jan. 5, 2012

(30) Foreign Application Priority Data

Mar. 17, 2009 (EP) ..... 09155341

(51) Int. Cl.

| | |
|---|---|
| ***F23R 3/02*** | (2006.01) |
| ***F23R 3/04*** | (2006.01) |
| ***F23R 3/28*** | (2006.01) |
| *F23R 3/34* | (2006.01) |

(52) U.S. Cl.

CPC . *F23R 3/286* (2013.01); *F23R 3/02* (2013.01); *F23R 3/04* (2013.01); *F23R 3/34* (2013.01)

(58) Field of Classification Search

CPC ..... F23R 3/002; F23R 3/04; F23R 3/286; F23R 3/34; F23R 3/06

USPC ..... 60/737, 738, 742, 747, 760

See application file for complete search history.

(56) References Cited

U.S. PATENT DOCUMENTS

| | | | | |
|---|---|---|---|---|
| 5,263,316 | A | 11/1993 | Shekleton | |
| 5,331,814 | A * | 7/1994 | Sandelis | 60/747 |
| 5,778,676 | A * | 7/1998 | Joshi et al. | 60/746 |
| 6,267,585 | B1 | 7/2001 | Suttrop | |
| 6,383,445 | B1 | 5/2002 | Anderson et al. | |
| 6,427,446 | B1 * | 8/2002 | Kraft et al. | 60/737 |
| 6,623,267 | B1 | 9/2003 | Golladay, Jr. | |
| 7,000,403 | B2 * | 2/2006 | Henriquez et al. | 60/776 |

FOREIGN PATENT DOCUMENTS

| | | | |
|---|---|---|---|
| CN | 1239207 | A | 12/1999 |
| CN | 101294714 | A | 10/2008 |
| EP | 0978491 | A2 | 2/2000 |
| EP | 1331441 | A1 | 7/2003 |
| EP | 1526332 | A2 | 4/2005 |

(Continued)

*Primary Examiner* — Andrew Nguyen

(57) ABSTRACT

A method for operating a burner comprising a burner axis and at least one jet nozzle is provided. The nozzle or nozzles include a central axis, a jet nozzle outlet, a wall that runs in a radial direction starting from the central axis and that faces the burner axis and a volumetric fluid flow that includes a fuel and flows through the jet nozzle or nozzles to the jet nozzle outlet. An air film is formed at the jet nozzle outlet between the volumetric fluid flow including the fuel and the wall that faces the burner axis by means of air that is injected into the jet nozzle or nozzles along the wall that faces the burner axis.

17 Claims, 4 Drawing Sheets

(56) References Cited

FOREIGN PATENT DOCUMENTS

| | | | |
|---|---|---|---|
| EP | 1241334 | B1 | 7/2005 |
| EP | 2078898 | A1 | 7/2009 |
| JP | 3182730 | B2 | 7/2001 |
| JP | 2002332870 | A | 11/2002 |
| JP | 2004170010 | A | 6/2004 |
| JP | 2005061715 | A | 3/2005 |
| JP | 2007232325 | A | 9/2007 |
| JP | 2008292139 | A | 12/2008 |
| RU | 2055271 | C1 | 2/1996 |
| RU | 2215243 | C2 | 10/2003 |
| RU | 2241177 | C2 | 11/2004 |
| WO | WO 9516881 | A1 | 6/1995 |

* cited by examiner

METHOD FOR OPERATING A BURNER AND BURNER, IN PARTICULAR FOR A GAS TURBINE

CROSS REFERENCE TO RELATED APPLICATIONS

This application is the US National Stage of International Application No. PCT/EP2010/053325, filed Mar. 16, 2010 and claims the benefit thereof. The International Application claims the benefits of European Patent Office application No. 09155341.2 EP filed Mar. 17, 2009. All of the applications are incorporated by reference herein in their entirety.

FIELD OF INVENTION

The present invention relates to methods for operating a burner, to a burner and to a gas turbine.

BACKGROUND OF INVENTION

Because of their distributed heat release zones and the absence of swirl-induced vortex, premixed jet flame based combustion systems offer advantages compared to swirl-stabilized systems, in particular from a thermoacoustic point of view. By appropriate selection of the jet momentum, small-scale flow structures can be produced which dissipate acoustically induced heat release fluctuations and therefore suppress pressure pulsations that are typical of swirl-stabilized flames.

The jet flames are stabilized by mixing-in hot recirculating gases. The fuel distribution in the premixing section is an important parameter for setting the DOC-specific combustion state, which is characterized by delayed ignition of the fresh gas mixture and a distributed heat release zone. As the fuel distribution in the premixing section depends not only on the fuel distributor used but also on the air flow to the jet nozzle, which can also be load-dependent, additional measures must be taken to set the desired fuel profile reliably.

SUMMARY OF INVENTION

Against this background, a first object of the present invention is to provide an advantageous method for operating a burner. A second object consists in providing an advantageous burner. A third object of the present invention consists in providing an advantageous gas turbine.

The first object is achieved by a method as claimed in the claims, the second object by a burner as claimed in the claims and the third object by a gas turbine as claimed in the claims. The dependent claims contain further advantageous embodiments of the invention.

The method according to the invention for operating a burner relates to a burner which comprises a burner axis and at least one jet nozzle. Typically, however, a number of jet nozzles disposed around the burner axis will be present. The at least one jet nozzle comprises a central axis, a jet nozzle outlet and a wall running in a radial direction from the central axis and facing the burner axis. A fluid mass flow containing a fuel passes through the at least one jet nozzle to the jet nozzle outlet. The method according to the invention is characterized in that an air or inert gas film is formed at the jet nozzle outlet between the fuel-containing fluid mass flow and the wall facing the burner axis by air or inert gas being injected along the wall facing the burner axis into the at least one jet nozzle.

In the context of the present invention, at least the region of the jet nozzle wall located between the central axis of the jet nozzle and the burner axis will be termed the wall facing the burner axis.

It is particularly advantageous in the context of the method according to the invention to have no or very little fuel in the region of the jet nozzle outlet facing the burner axis. This is because too much fuel in this region can result in excessively rapid ignition of the flame which in this case is undesirable. Since in the present method no or only very little fuel is present in this region, ignition is delayed. Delayed ignition allows on the one hand a greater mixing length, resulting in a lower nitrogen oxide value. On the other hand delayed ignition allows distributed heat release, which is advantageous from a thermoacoustic standpoint.

With the aid of the present invention, by selective air or inert gas injection for film formation in the jet nozzle, the fuel profile is basically modified such that, for example, the part of the profile facing the burner axis contains no or only very little fuel. The objective here should be to use as little air or inert gas as possible for setting the profile.

The at least one jet nozzle can have a circumferential direction running around the central axis. In this case the air or the inert gas can be injected into the jet nozzle in the circumferential direction in an angular range of at least ±15°, referred to a radial connecting line between the burner axis and the central axis. The effect of this is that the part of the fuel profile facing the burner axis contains no or only very little fuel.

In addition, the air or the inert gas can be injected into the jet nozzle in the circumferential direction in an angular range of at most ±135°, in particular in an angular range of at most between ±90° and more particularly of at most ±45°, referred to a radial connecting line between the burner axis and the central axis. In this case, if adjacent jet nozzles are present, air or inert gas can also be injected at the sides facing the adjacent jets. This air or inert gas prevents the jet flames from coalescing and therefore provides an advantageous heat release zone, as is the objective for jet flame based burner systems. The air or inert gas injection on the sides facing the adjacent jets can be implemented bilaterally or only unilaterally.

In addition, the air can be injected into the jet nozzle in the circumferential direction about the central axis in an asymmetrical angular range of at most −135° to +45° or at most −45° to +135°, referred to a radial connecting line between the burner axis and the central axis, thereby achieving unilateral air or inert gas injection on the sides facing the adjacent jets.

The at least one jet nozzle can basically comprise a central axis. The air or the inert gas can be advantageously injected into the jet nozzle at an angle of between 0° and 60° to the central axis.

The burner according to the invention comprises a burner axis and at least one jet nozzle. However, it can also comprise a number of jet nozzles disposed about the burner axis. The at least one jet nozzle comprises a central axis and a wall area extending around same in an angular range of at most −135° to +135° and of at least −15° to +15°, referred to a radial connecting line between the burner axis and the central axis (hereinafter also referred to as the wall facing the burner axis). The burner according to the invention is characterized in that only the wall area extending around the central axis in an angular range of at most −135° to +135° and of at least −15° to +15° comprises at least one flow channel feeding into the jet nozzle to supply air or inert gas. The burner according to the invention is suitable for implementing the above-described inventive method. In particular, the flow channel can be connected to an air reservoir or an inert gas source.

The wall area comprising the at least one flow channel feeding into the jet nozzle can in particular also extend around the central axis in an angular range of at most ±90, in particular at most ±45 or at most −45° to +135° or at most −135° to +45°. In the two latter variants, unilateral air or inert gas injection on the sides facing the adjacent jets is achieved in each case.

The flow channel can be advantageously embodied as a bore or partial annular gap. In particular, the bore can comprise a central axis which, with the central axis of the jet nozzle, includes an angle of between 0° and 60°, in particular between 20° and 40°. The injected air or the injected inert gas entrained by the main flow in the jet nozzle then forms a particularly advantageous film. The bore can have, for example, a circular, an elliptical or any other cross-section. The bore can advantageously have a profiled outlet cross-section corresponding to that of film cooling holes. Similarly to the film cooling air, the requirement for the injected air or the injected inert gas is that it mixes as little as possible with the core flow.

If the flow channel is embodied as a partial annular gap, the partial annular gap can constitute a notional partial cone envelope which, with the central axis of the jet nozzle, can include an angle of between 0° and 60°, in particular between 20° and 40°. Advantageously, the partial annular gap can comprise a plurality of partial annular gap segments, thereby providing better controllability of the gap size.

In addition, the partial annular gap can be embodied such that it closes or opens as a function of the operating conditions. For example, it can be implemented such that it closes or opens due to thermal expansion of a structural element, in particular due to thermal expansion of the adjacent components. For example, the burner can comprise a pilot fuel nozzle and the partial annular gap can be embodied such that the partial annular gap closes or opens as a function of the temperature of the pilot fuel nozzle. Thus, in particular a hot pilot fuel nozzle in the partial load range can cause the gap to close, whereas in the case of very little pilot gas, i.e. with a cooler pilot fuel nozzle compared to the partial load range, the gap attains a maximum size close to base load.

The burner according to the invention permits the use of air films or inert gas films in order to model the mixture profile for a jet burner in an optimum manner for the operation thereof.

The gas turbine according to the invention comprises at least one previously described burner according to the invention. Its characteristics and advantages derive from those of the already described burner according to the invention. Altogether, through the use of air films or inert gas films, the present invention allows the mixture profile to be modeled for a jet burner so as to optimize said profile for operation of the gas turbine.

BRIEF DESCRIPTION OF THE DRAWINGS

Further features, characteristics and advantages of the present invention will be described in greater detail below with reference to an exemplary embodiment taken in conjunction with the accompanying drawings, the features described being advantageous both individually and in combination with one another.

DETAILED DESCRIPTION OF INVENTION

Figure 1:
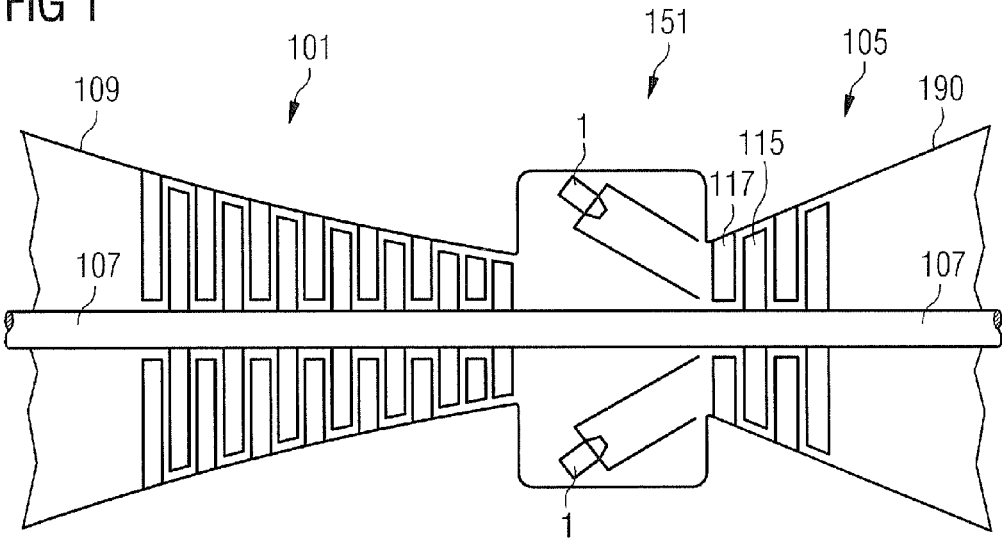
FIG. 1 schematically illustrates a gas turbine.

Exemplary embodiments of the invention will be explained in greater detail below with reference to FIGS. 1 to 13. FIG. 1 schematically illustrates a gas turbine. A gas turbine incorporates a rotor with a shaft 107, also known as a turbine runner, pivotally mounted around a rotational axis. Along the rotor are successively mounted an intake housing 109, a compressor 101, a combustion system 151 with a number of jet burners 1, a turbine 105 and the exhaust housing 190.

The combustion system 151 communicates with an annular hot gas path where a plurality of series-connected turbine stages constitute the turbine 105. Each turbine stage is composed of blade rings. Viewed in the flow direction of a working fluid, a stationary blade ring 117 is followed in the hot gas path by a rotor blade ring composed of rotor blades 115. Said stationary blades 117 are mounted on an internal housing of a stator, whereas the rotor blades 115 of a rotor blade ring are mounted on the rotor e.g. by means of a turbine disk. Coupled to the rotor is a generator or a driven machine.

During operation of the gas turbine, air is sucked in through the intake housing 109 and compressed by the compressor 101. The compressed air provided at the turbine end of the compressor 101 is fed to the combustion system 151 where it is mixed with a fuel. The mixture is then burned in the combustion system 151 using the jet burner 1 with the formation of the working fluid. From there the working fluid flows along the hot gas path past the stationary blades 117 and the rotor blades 115. At the rotor blades 115, the working fluid expands in a pulse-transmitting manner so that the rotor blades 115 drive the rotor and the latter the driven machine or the generator coupled thereto (not shown).

The combustion system 151 comprises at least one burner according to the invention and can basically incorporate an annular combustion chamber or a plurality of cylindrical can-type combustion chambers.

Figure 2:
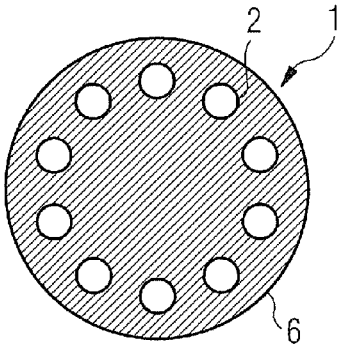
FIG. 2 schematically illustrates a section through a jet burner perpendicular to its longitudinal axis.

The FIG. 2 schematically illustrates a section through a jet burner 1 perpendicular to a central axis 4 of the burner 1. The burner 1 comprises a housing 6 which has an essentially circular cross-section. Disposed in an essentially annular manner inside the housing 6 are a particular number of jet nozzles 2. Each jet nozzle 2 has a circular cross-section. The burner 1 can essentially comprise a pilot burner.

Figure 3:
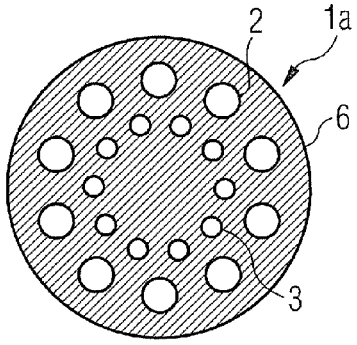
FIG. 3 schematically illustrates a section through another jet burner perpendicular to its longitudinal axis.

FIG. 3 schematically illustrates a section through an alternative jet burner 1*a*, said section running perpendicularly to the central axis of the burner 1*a*. The burner 1*a* likewise has a housing 6 which possesses a circular cross-section and in which are disposed a number of inner and outer jet nozzles 2, 3. The jet nozzles 2, 3 have in each case a circular cross-section, the outer jet nozzles 2 possessing a cross-sectional area of the same size as or greater than that of the inner jet nozzles 3. The outer jet nozzles 2 are essentially disposed annularly inside the housing 6 and form an outer ring. The inner jet nozzles 3 are likewise disposed annularly inside the housing 6. The inner jet nozzles 3 form an inner ring which is disposed concentrically to the outer jet nozzle ring.

FIGS. 2 and 3 merely show examples of the arrangement of jet nozzles 2, 3 inside a jet burner 1, 1*a*. It is self-evident that alternative arrangements are possible, as is the use of a different number of jet nozzles 2, 3.

Figure 4:
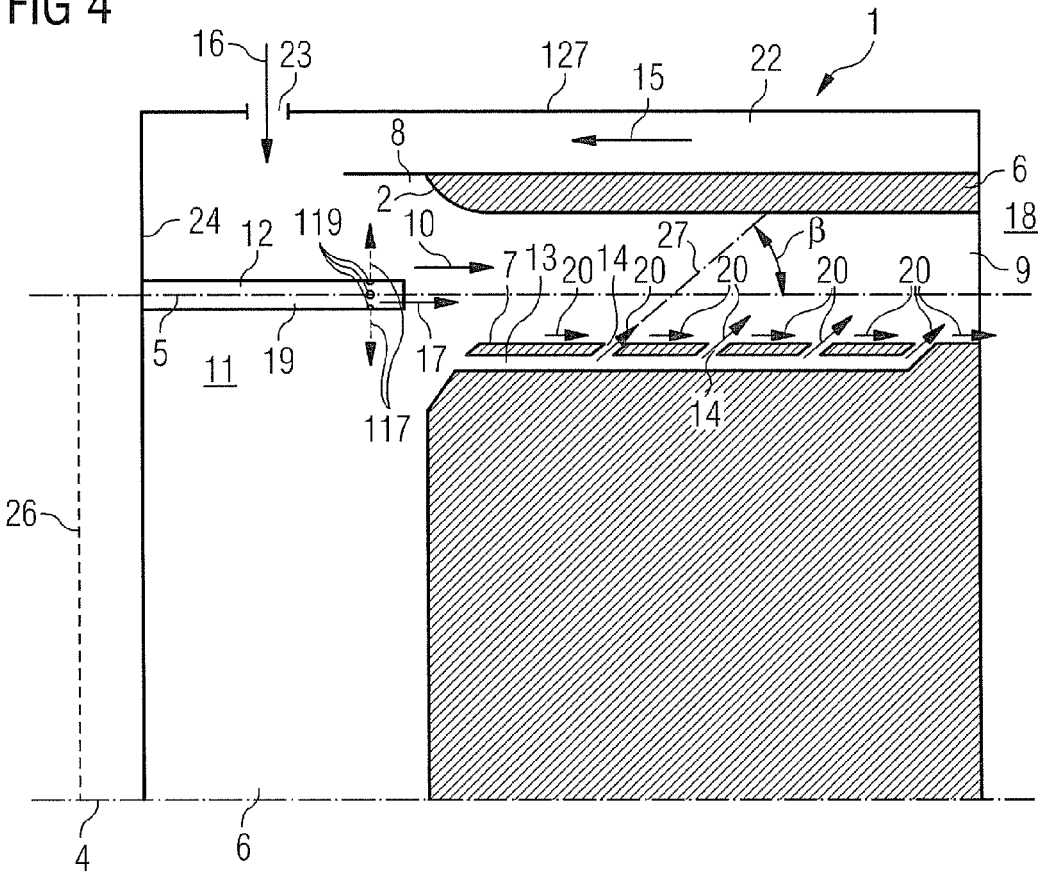
FIG. 4 schematically illustrates a section through part of a jet burner in the longitudinal direction.

FIG. 4 schematically illustrates a section through part of a jet burner 1 according to the invention in the longitudinal direction, i.e. along the central axis 4 of the burner 1. The burner 1 has at least one jet nozzle 2 disposed in a housing 6. The central axis of the jet nozzle is denoted by the reference numeral 5. The jet nozzle 2 comprises a jet nozzle inlet 8 and a jet nozzle outlet 9. Adjacent to the jet nozzle outlet 9 is the combustion chamber 18. The jet nozzle 2 is also disposed in the housing 6 such that the jet nozzle inlet 8 faces the back wall 24 of the burner 1. The housing 6 additionally comprises a radially outer housing section 127 in relation to the central axis 4 of the burner 1.

The jet nozzle 2 is fluidically connected to a compressor. The compressed air from the compressor is fed via an annular gap 22 to the jet nozzle inlet 8 and/or fed radially with respect to the central axis 5 of the jet nozzle 2 via an air inlet orifice 23 to the jet nozzle inlet 8. In the event that the compressed air is fed through the annular gap 22 of the jet nozzle 2, the compressed air flows through the annular gap 22 in the direction of the arrow denoted by the reference numeral 15, i.e. parallel to the central axis 5 of the jet nozzle 2. The air flowing in the direction of the arrow 15 is then deflected through 180° by the back wall 24 of the burner 1 and subsequently flows through the jet nozzle inlet 8 into the jet nozzle 2. The flow direction of the air inside the jet nozzle 2 is indicated by an arrow 10.

In addition or alternatively to supplying the compressed air through the annular gap 22, the compressed air coming from the compressor can also be fed through an orifice 23 disposed radially in the housing 6 of the burner 1 with respect to the central axis 5 of the jet nozzle 2. The flow direction of the compressed air flowing through the orifice 23 is indicated by an arrow 16. In this case the compressed air is next deflected through 90° and then flows through the jet nozzle inlet 8 into the jet nozzle 2.

Also located at the jet nozzle inlet 8 is a fuel nozzle 19 through which a fuel 12 is injected into the jet nozzle 2. The flow direction of the fuel is denoted by the reference numeral 17. At its circumference, the fuel nozzle 19 can additionally or alternatively have fuel outlet orifices 119 via which fuel can be introduced in the direction of the dashed arrows 117 shown in FIG. 4.

The jet nozzle 2 additionally comprises a wall 7 facing the burner axis 4. By wall 7 facing the burner axis 4 is meant at least the area of the jet nozzle wall located between the central axis 5 of the jet nozzle 1 and the burner axis 4. The wall 7 facing the burner axis can in particular extend around the central axis 5 in an angular range of at most −135° to +135° and at least −15° to +15°, referred to the radial connecting line 26 between the burner axis 4 and the central axis 5.

In the region of the wall 7 facing the burner axis there is located, inside the housing 6, an air supply line 13 connected to the compressor. From the air supply line 13, air inlet orifices 14 lead into the interior of the jet nozzle 2. In the present embodiment variant the air inlet orifices 14 are implemented as bores with a circular cross-section. They each comprise a central axis 27 which, with the central axis 5 of the jet nozzle 2, include an angle β which can be, for example, between 0° and 60°, in particular between 20° and 40°. Instead of air, an inert gas can also be supplied via the supply line. In this case the line 13 is not connected to the compressor, but to an inert gas reservoir or an inert gas source.

Through the air supply line 13 and the air inlet orifices 14, air is injected into the jet nozzle 2 such that it is entrained by the main flow indicated by the arrow 10 and therefore forms an air film along the wall 7 facing the burner axis 4. The flow direction of the injected air is denoted by the reference numeral 20.

The burner according to the invention 1 can basically be implemented even without the outer housing section 127, i.e. without an outer housing 127. In this case the compressed air can flow directly into the "plenum", i.e. the area between the back wall 24 and the jet nozzle inlet 8. In addition, the burner according to the invention 1 can also be implemented without the back wall 24.

Figure 5:
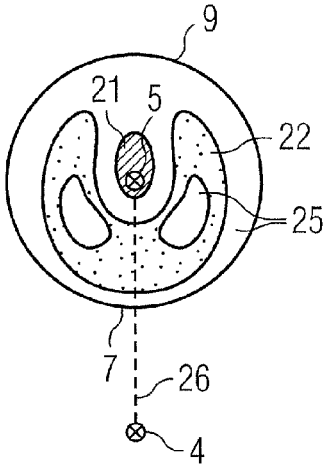
FIG. 5 schematically illustrates an unsatisfactory fuel profile at the jet nozzle outlet.

FIG. 5 schematically illustrates a fuel profile of the kind produced at the jet nozzle outlet without the inventive air film generation on the wall facing the burner axis. The radial connecting line between the central axis 5 of the jet nozzle 2 and the central axis of the burner 4 is denoted by the reference numeral 26 for orientation purposes.

The burner profile schematically illustrated in FIG. 5 is characterized in that a fuel-rich region 25 is formed in the outer region of the jet nozzle 2, i.e. on the jet nozzle wall. Two additional fuel-rich regions 25 are located in the vicinity of the central axis of the jet nozzle 5. Also located in the vicinity of the central axis of the jet nozzle 5 are a fuel-free or fuel-lean region 21, as well as a region 22 in which the desired air-fuel mixture 22 predominates. The fuel profile schematically illustrated in FIG. 5 is disadvantageous, since fuel 25 predominates on the wall 7 facing the burner axis. This fuel-rich region 25 is caused by air flowing to the jet nozzle 2.

Figure 6:
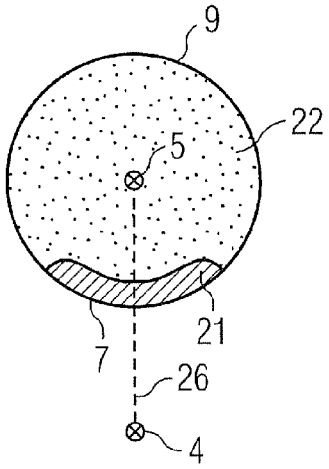
FIG. 6 schematically illustrates an advantageous fuel profile at the jet nozzle outlet.

Using the method according to the invention, i.e. by injecting air along the wall 7 facing the burner axis with the formation of an air film, the fuel profile schematically illustrated in FIG. 6 can be produced. This profile is characterized in that a fuel-free region 21 predominates on the wall 7 facing the burner axis. The region 21 is ideally fuel-free, but can also be fuel-lean. The fuel profile shown in FIG. 6 is advantageous, since the air film 21 on the wall 7 facing the burner axis prevents premature ignition of the jet flames and makes a distributed heat release zone possible.

Figure 7:
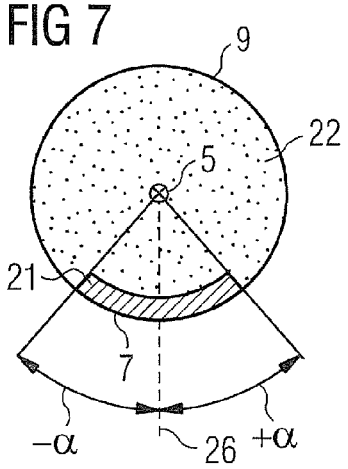
FIG. 7 schematically illustrates another advantageous fuel profile at the jet nozzle outlet.
Figure 8:
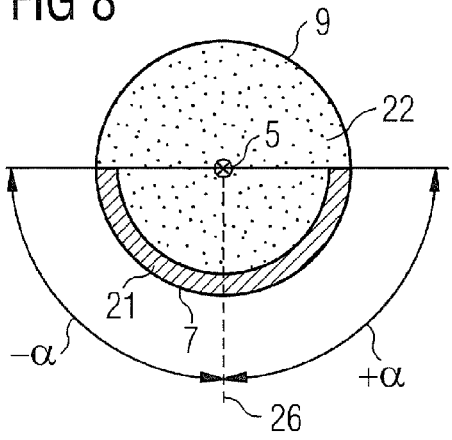
FIG. 8 schematically illustrates another advantageous fuel profile at the jet nozzle outlet.

FIGS. 7 to 12 schematically illustrate various fuel profiles at the jet nozzle outlet 9, such as can be produced using the method according to the invention, in particular using a burner according to the invention. The fuel profile shown in FIG. 7 is characterized in that a fuel-free or fuel-lean region is faulted along the wall 7 facing the burner axis at an angle of −α to +α about the central axis 5 of the jet nozzle 2 starting from a radial connecting line 26 between the central axis 5 of the jet nozzle 2 and the burner axis 4. In FIG. 7 the angle α is approximately 45°. The fuel-free or fuel-lean region 21 is produced by injecting air at an angle of −α to +α around the central axis 5 of the jet nozzle 2 starting from the connecting line 26. In FIG. 8 the angle α is 90°, in FIG. 9 it is 15° and in FIG. 10 it is 135°.

Figure 9:
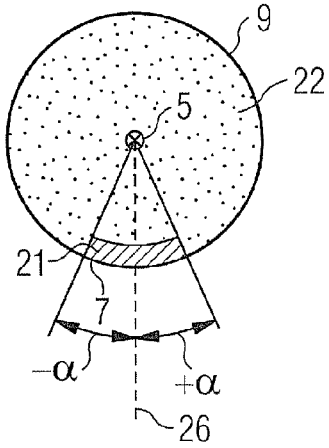
FIG. 9 schematically illustrates another advantageous fuel profile at the jet nozzle outlet.
Figure 10:
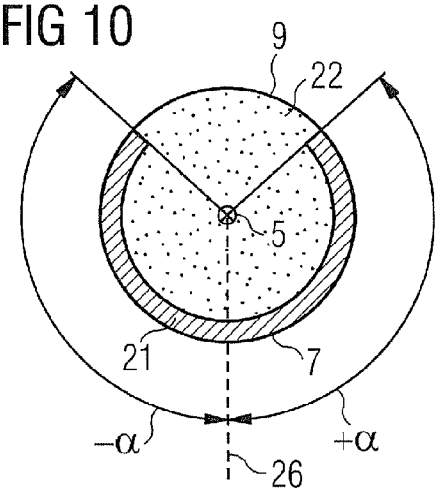
FIG. 10 schematically illustrates another advantageous fuel profile at the jet nozzle outlet.

The fuel profile shown in FIG. 10, unlike the profiles shown in FIG. 7 and FIG. 9, is characterized in that, in addition to shielding of the fuel by an air film in the direction of the burner axis 4, shielding toward the respective adjacent jet nozzles is also achieved, thereby preventing the flames from coalescing.

Figure 11:
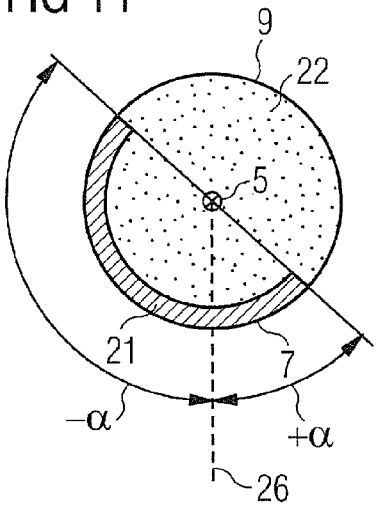
FIG. 11 schematically illustrates another advantageous fuel profile at the jet nozzle outlet.

The fuel profile shown in FIG. 11 is characterized by a fuel-free or fuel-lean region 21 which extends in an asymmetrical angular range of −135° to +45° around the central axis 5 of the jet nozzle starting from the connecting line 26. By means of the profile shown in FIG. 11, unilateral shielding toward an adjacent jet nozzle and in the direction of the central axis 4 of the burner is achieved. This configuration is advantageous in order to minimize the amount of air or inert gas used as far as possible.

Figure 12:
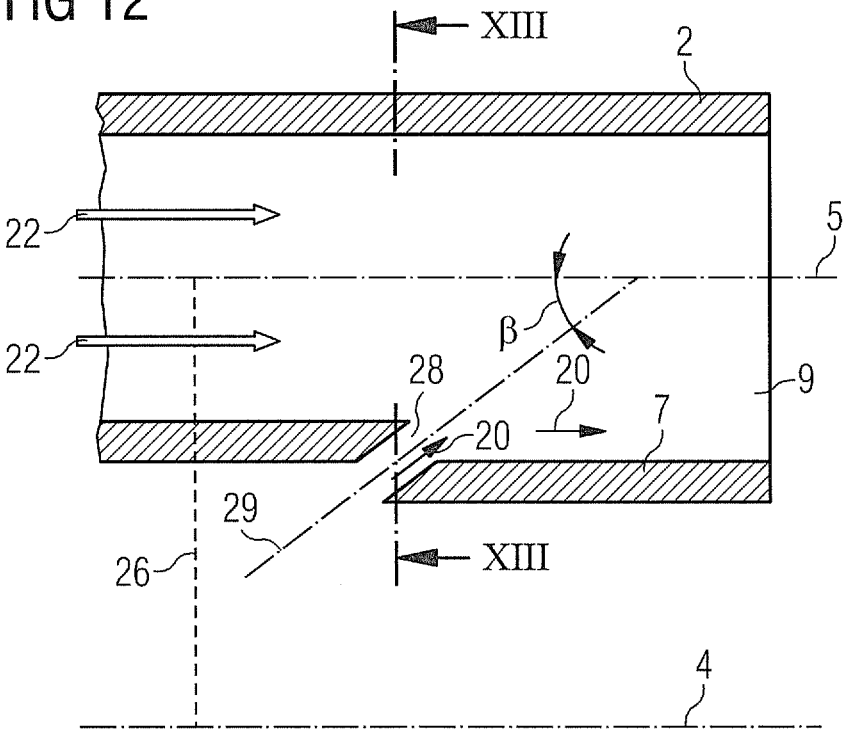
FIG. 12 schematically illustrates a section through part of a jet nozzle in the longitudinal direction.
Figure 13:
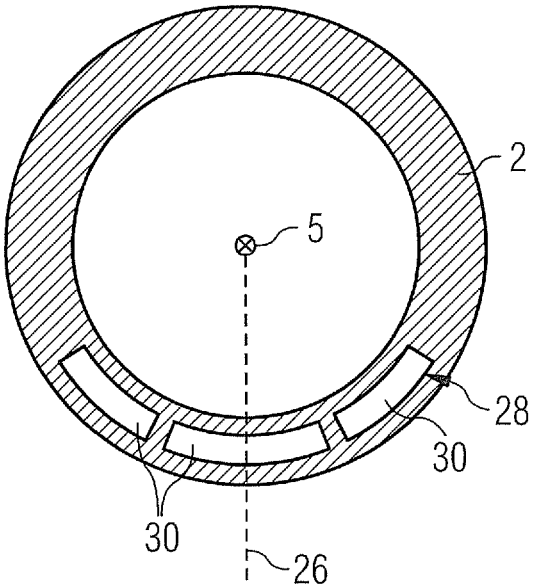
FIG. 13 schematically illustrates a section through the jet nozzle shown in FIG. 12 along XIII-XIII.

FIGS. 12 and 13 show another embodiment variant of the burner according to the invention using a partial annular gap. FIG. 12 schematically illustrates a section through part of a jet nozzle in the longitudinal direction. FIG. 13 shows a section, perpendicular to the central axis 5, through the jet nozzle in FIG. 12.

The jet nozzle 2 shown in FIGS. 12 and 13 comprises a partial annular gap 28. Air is injected through the partial annular gap 28 along the flow direction 20 into the inside of the jet nozzle 2. As a result of the flow 22 of the air-fuel mixture passing through the jet nozzle 2, an air film is formed along the wall 7 facing the burner axis.

The partial annular gap 28 forms a notional partial cone envelope which is denoted by the reference numeral 29 and forms an angle β of between 0° and 60°, in particular of between 20° and 40°, with the central axis 5 of the jet nozzle 2.

FIG. 13 schematically illustrates a section along XIII-XIII of the jet nozzle shown in FIG. 12. The partial annular gap 28 shown in FIG. 13 comprises a plurality of partial annular gap segments, in the present embodiment variant three partial annular gap segments 30. The embodiment of the partial annular gap 28 from a plurality of partial annular gap segments 30 provides better controllability of the gap size, in particular controllability and adjustability of the angular range α for the air film to be produced. In addition, the embodiment using partial annular gap segments 30 increases the stability of the jet nozzle 2 in the region of the partial annular gap 28.

The partial annular gap 28 can be implemented such that it closes or opens as a function of the operating conditions, e.g. as a result of thermal expansion of a structural element. In particular, the burner 1 can comprise at least one pilot fuel nozzle and the partial annular gap 28 can be implemented and be in thermal contact with the pilot fuel nozzle such that it closes or opens as a function of the temperature of the pilot fuel nozzle. For example, a hot pilot fuel nozzle during partial load operation can cause the partial annular gap 28 to close, while the partial annular gap 28 attains a maximum size when there is very little pilot gas close to base load, i.e. in the case of a cooler pilot fuel nozzle.

The invention claimed is:

1. A method for operating a burner, comprising: providing a burner axis and a jet nozzle, wherein the jet nozzle includes a central axis, a jet nozzle outlet and a wall facing the burner axis in a radial direction starting from the central axis, and a fluid mass flow containing a fuel passes through the jet nozzle to the jet nozzle outlet, wherein the wall of the jet nozzle comprises a circular or elliptical cross-section; and injecting air along the wall facing the burner axis into the jet nozzle forming an air or inert gas film at the jet nozzle outlet between the fuel-containing fluid mass flow and the wall facing the burner axis, wherein the jet nozzle includes a circumferential direction running around the central axis, and the air or the inert gas is injected into the jet nozzle in the circumferential direction in an angular range from at least +/−15° about the central axis to an angular range of at most +/−135° about the central axis, wherein the zero angle of the angular range is defined at a radial connecting line between the burner axis and the central axis.

2. The method as claimed in claim 1, wherein the jet nozzle includes the circumferential direction running around the central axis and the air or the inert gas is injected into the jet nozzle in the circumferential direction in the angular range of at most ±90° about the central axis.

3. The method as claimed in claim 2, wherein the jet nozzle includes a circumferential direction running around the central axis and the air or the inert gas is injected into the jet nozzle in the circumferential direction in the angular range of at most ±45° about the central axis.

4. The method as claimed in claim 1, wherein the jet nozzle includes a circumferential direction running around the central axis and the air or the inert gas is injected into the jet nozzle in the circumferential direction around the central axis in the angular range of at most −135° to +45°, or of at most −45° to +135° about the central axis.

5. The method as claimed in claim 1, wherein the air or the inert gas is injected into the jet nozzle at an angle of between 0° and 60° with respect to the central axis.

6. A burner, comprising:

a burner axis; and a jet nozzle including a central axis, an air inlet, a jet nozzle outlet and a wall facing the burner axis in a radial direction starting from the central axis, the jet nozzle fluidly coupled to receive through the air inlet a flow of air that is directed along the wall facing the burner axis to form an air or inert gas film at the jet nozzle outlet between a fuel-containing fluid mass flow and the wall facing the burner axis, wherein the wall of the jet nozzle comprises a circular or elliptical cross-section, wherein the jet nozzle comprises a first central axis and a wall area extending around the central axis in an angular range from at most −135° to +135° about the central axis to an angular range of at least −15° to +15° about the central axis, wherein the zero angle of the angular range is defined at a radial connecting line between the burner axis and the central axis, and wherein only the wall area extending around the first central axis in the angular range of at most −135° to +135° and at least −15° to +15° comprises a flow channel feeding into the jet nozzle to supply air or an inert gas.

7. The burner as claimed in claim 6, wherein the flow channel is embodied as a bore.

8. The burner as claimed in claim 6, wherein the flow channel is embodied as a partial annular gap.

9. The burner as claimed in claim 7, wherein the bore comprises a second central axis which, with the first central axis of the jet nozzle, includes an angle of between 0° and 60°.

10. The burner as claimed in claim 8, wherein the partial annular gap forms a notional partial cone envelope which, with the first central axis of the jet nozzle, includes an angle of between 0° and 60°.

11. The burner as claimed in claim 8, wherein the partial annular gap comprises a plurality of partial annular gap segments.

12. The burner as claimed in claim 7, wherein the bore includes a profiled outlet cross-section corresponding to that of a plurality of film cooling orifices.

13. The burner as claimed in claim 8, wherein the partial annular gap is embodied such that it closes or opens as a function of the operating conditions.

14. The burner as claimed in claim 13, wherein the partial annular gap is embodied such that it closes or opens due to thermal expansion of a structural element.

15. The burner as claimed in claim 13, wherein the burner comprises a pilot fuel nozzle and the partial annular gap is embodied such that it closes or opens as a function of a temperature of the pilot fuel nozzle.

16. A gas turbine, comprising:

a burner as claimed in claim 6.

17. The gas turbine as claimed in claim 16, wherein the flow channel is embodied as a bore.

* * * * *